United States Patent [19]

Suffi et al.

[11] Patent Number: 5,044,981

[45] Date of Patent: Sep. 3, 1991

[54] SNAP-ON STACKING TELEPHONE JACK

[75] Inventors: Louis Suffi, Westchester; Ronald G. Sommers, Algonquin, both of Ill.

[73] Assignee: Reliance Comm/Tec Corporation, Chicago, Ill.

[21] Appl. No.: 510,524

[22] Filed: Apr. 18, 1990

[51] Int. Cl.[5] ..... H01R 13/627

[52] U.S. Cl. ..... 439/533; 439/557; 439/676

[58] Field of Search ..... 439/533, 544, 545, 557, 439/567, 676

[56] References Cited

U.S. PATENT DOCUMENTS

| | | | |
|---|---|---|---|
| 3,273,104 | 9/1966 | Krol . | |
| 3,516,045 | 6/1970 | Gaines et al. . | |
| 4,040,699 | 8/1977 | Rasmussen . | |
| 4,451,106 | 5/1984 | Wiseheart et al. . | |
| 4,460,234 | 7/1984 | Bogese | 439/557 |
| 4,494,815 | 1/1985 | Brzostek et al. . | |

FOREIGN PATENT DOCUMENTS

| | | | |
|---|---|---|---|
| 2169156 | 7/1986 | United Kingdom | 439/676 |

*Primary Examiner*—Eugene F. Desmond

*Attorney, Agent, or Firm*—Trexler, Bushnell, Giangiorgi & Blackstone, Ltd.

[57] ABSTRACT

A communication line plug coupler is for use in a multi-line equipment panel which snap fits into an aperture formed through a surface of the panel. The coupler receives at least one communication line plug on each side of the panel providing a primary demarcation point in determining system problems. The coupler comprises a coupler body having a front portion and a rear portion with an RJ11 plug receptacle formed in the front portion and an insert receptacle formed in the rear portion. The front portion is integrally formed with flexible retention means for retaining the coupler in engagement through the aperture formed in the panel. The receptacles are formed in the coupler for positioning removably engagable plugs inserted in each receptacle for electrical engagement therebetween. The coupler is integrally formed as a single piece body of a material such as plastic having insulating characteristics for insulating the coupler from the panel.

8 Claims, 2 Drawing Sheets

SNAP-ON STACKING TELEPHONE JACK

BACKGROUND OF THE INVENTION

This invention relates generally to the communication equipment connector arts and more particularly to communication line plug couplers, such as telephone jacks.

Currently, multiline equipment panels are manufactured which provide a network interface for a plurality of customer service lines. These multiline equipment panels are used in apartment buildings, office complexes and other high density phone installations. Typically, a customer line from within the building terminates in an RJ11 type telephone plug. This plug interfaces to the network interface terminal, providing a demarcation point between customer equipment and service provider equipment. This proves useful for testing individual customer lines in the event of a problem by permitting a service person to isolate the source of the problem.

From the network interface terminal, the individual customer line is continued to a line protector/arrester to protect the line from overvoltage or undercurrent.

This link of the customer line terminates at the network interface typically in a prewired coupler which is formed with a RJ11 plug receptacle. The prewired coupler is prewired with conductive prongs which mate with spades mounted within the RJ11 plug to provide a conductive path.

In a multiline network interface, the prewired couplers are mounted to a bar using fasteners and the bar, including prewired couplers, is mounted to a panel having a corresponding number of apertures formed therethrough to receive the ends of the prewired couplers. When installed, the RJ11 plug is merely plugged into a corresponding prewired coupler. When a problem arises, the RJ11 plug is removed from the coupler and testing is done at each end of the line; the RJ11 end, and the prewired coupler end which connects to the line protector/arrester.

A problem arises primarily in the assembly of the couplers to the panel in that each coupler must be individually mounted using fasteners thereby requiring additional labor, components, accounting and tracking associated with such components, and the additional costs incurred as a result of the additional components and labor. Further, the additional components increase the potential for component failure and the potential for error during assembly.

An additional problem arises when a coupler must be replaced in that it requires removal of the mounting bar with all of the plug couplers mounted thereto, removal of the defective coupler, and mounting a new coupler. Removal and replacement of the mounting bar with all of the couplers attached in order to replace perhaps only one defective coupler risks disturbing other couplers and their connections, which may fail when so disturbed. Further, because these multiline communication equipment panels are often mounted in hard-to-reach or confined places, it is often difficult to carry out repair operations on such small components which are individually attached using small fasteners such as the couplers to the mounting bar.

OBJECTS AND SUMMARY OF THE INVENTION

A general object of the present invention is to provide a communication line plug coupler which accommodates two communication line plugs and which snap fits into a multiline equipment panel without requiring discrete fasteners.

Another object of the present invention is to provide a communication line plug coupler which is integrally formed of plastic as a single piece body.

A more specific object of this invention is to provide a single piece integrally formed communication line plug coupler which snap fits into a multiline equipment panel which completes the circuits between the conductors of two communication line plugs inserted therein.

A further object of the present invention is to provide a communication line plug coupler which provides an environmental seal protecting the coupler and the communication line plugs engaged therein against detrimental environmental effects.

In accordance with the foregoing, the present invention comprises an integrally formed communication line plug coupler which snap fits into a multiline equipment panel. The plug coupler accepts at least two communication line plugs, the electrical conductors of which are thereby positioned for electrical interengagement. The plug coupler provides a primary demarcation point in determining system problems.

BRIEF DESCRIPTION OF THE DRAWINGS

The features of the present invention which are believed to be novel are set forth with particularity in the appended claims. The organization and manner of operation of the invention, together with the further objects and advantages thereof, may best be understood by reference to the following description taken in connection with the accompanying drawings in which like reference numerals identify like elements in which:

DETAILED DESCRIPTION OF THE ILLUSTRATED EMBODIMENT

Figure 1:
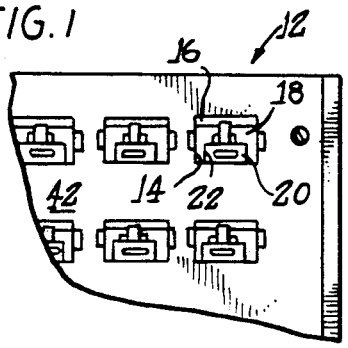
FIG. 1 is a partial front elevational view of a multiline panel of a network interface terminal in which a plurality of plug couplers are installed.

While this invention is susceptible to embodiment in many different forms, there is shown in the drawings and will be herein described in detail, one specific embodiment with the understanding that the present disclosure is to be considered an exemplification of the principles of the invention, and is not intended to limit the invention to the embodiment illustrated.

FIG. 1 provides a partial front elevational view of a multiline panel 12 having an aperture 14 formed therethrough, through which aperture 14 retention means 16 of a plug coupler 18 projects. With a series of plug couplers 18 mounted to the multiline panel 12 in a matrix of 100 or more such plug couplers, plugs such as RJ11 plugs 20 are inserted into complimentary receiving receptacles 22 formed therein.

Figure 2:
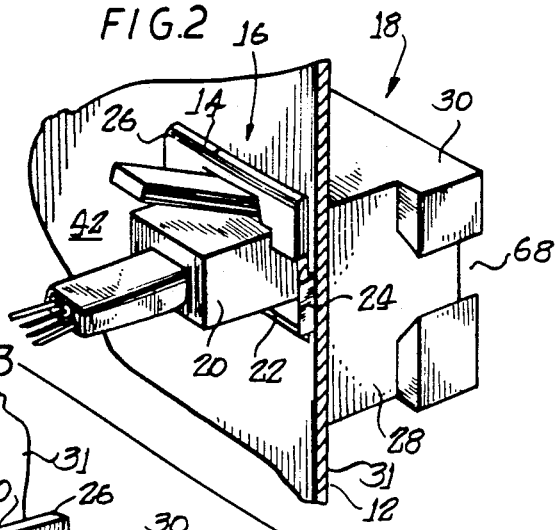
FIG. 2 is an enlarged partial sectional perspective view of a multiline panel through which a plug coupler is inserted as shown in FIG. 1.

FIG. 2 provides an enlarged partial sectional view of the multiline panel 12 as shown in FIG. 1 illustrating in greater detail one plug coupler 18 with an RJ11 plug 20 inserted therein. As shown in FIG. 2, the plug coupler 18 is retained on the mounting panel 12 by retention means 16. The retention means 16 comprise two side snap lock tabs 24 (of which only one side is shown) and a top snap lock tab 26. The retention means 16, as will be described in greater detail hereinbelow, are integrally formed on a front portion 28 of the plug coupler 18. The plug coupler 18 has a rear portion 30 which extends into a cabinet portion (not shown) on the inside surface 31 of the multiline panel 12.

Figure 3:
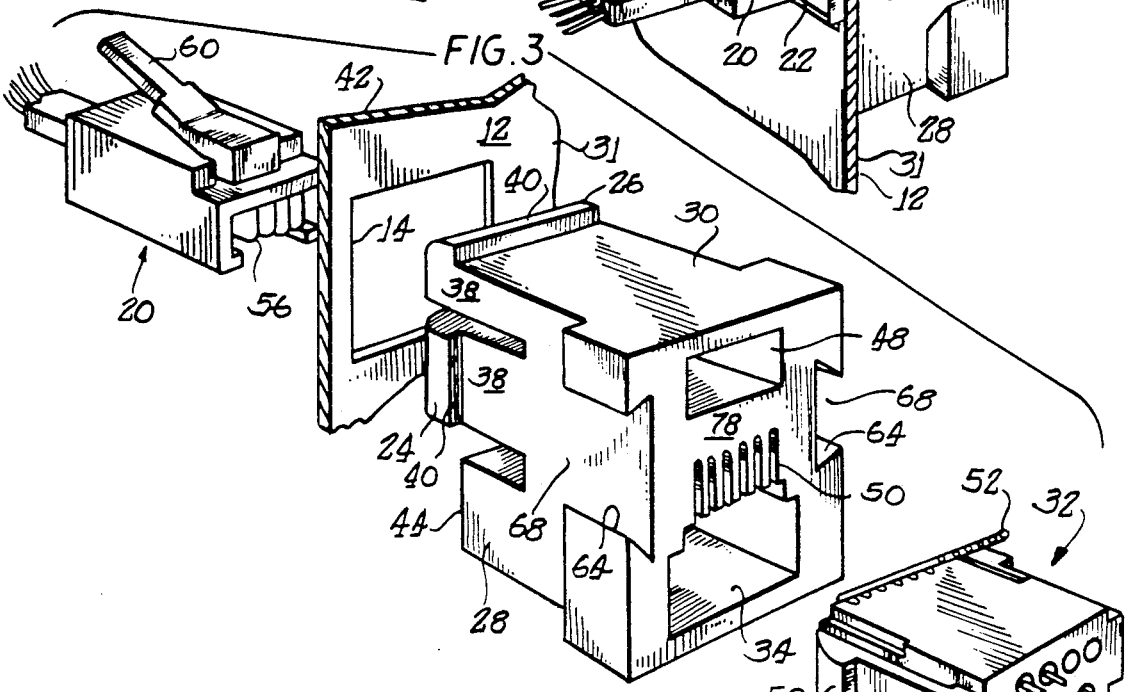
FIG. 3 is an exploded perspective view of the assembly shown in FIG. 2, as viewed from the rear of the plug coupler, showing the plugs removed from the plug coupler and the plug coupler disengaged from the multiline panel.

FIG. 3 provides an exploded view of the enlarged plug coupler 18 shown in FIG. 2 as viewed from the inside surface 31 of the multiline panel 12. As illustrated in FIG. 3, the RJ11 plug 20 is disconnected from the plug coupler 18, the plug coupler 18 is disengaged from the aperture 14 in the multiline panel 12 and an insert plug 32 is disengaged from an insert plug-receiving receptacle 34 formed in the rear portion 30 of the plug coupler 18.

Figure 4:
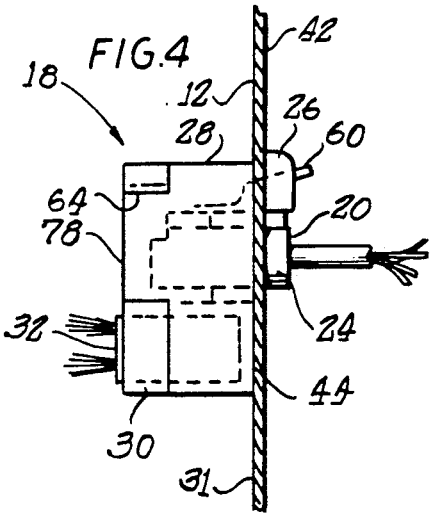
FIG. 4 is an enlarged right side view of one of the plug couplers as illustrated in FIG. 1.

The front portion 28 of the plug coupler 18 has the side snap lock tabs 24 formed on the left and right sides thereof and the top snap lock tab 26 formed on the top side thereof. Each snap lock tab 24, 26 is formed projecting from an outer end of a generally flexible snap lock arm portion 38, 39 integrally formed with the respective surface of the plug coupler 18. The flexibility of the flexible arm portions 38, 39 permits the arm portions 38, 39 to be inwardly flexed, thereby permitting the passage of the top 26 and side 24 tabs mounted on the ends thereof through the aperture 14 when the coupler 18 is inserted therethrough. Once the tabs 24, 26 have passed through the aperture 14, the flexible arm portions 38, 39 flex back to their relaxed "as-formed" state whereupon a projecting retaining edge or stop surface 40, 41 of the respective tabs 24, 26 engage an outer face 42 of the multiline panel 12. As shown in greater detail in FIG. 4, once the retention means 16 of the plug coupler 18 is engaged with the multiline panel 12, a restraining surface 44 formed on the front most portion of the plug coupler 18 abuts the inside face 31 of the multiline panel 12 to prohibit movement of the plug coupler 18 mounted thereagainst.

The rear portion 30 of the plug coupler 18 is formed with the insert plug-receiving receptacle 34 and a secondary RJ11 plug releasing port 48. In the embodiment illustrated in FIG. 3, the insert plug-receiving receptacle 34 is formed with prong guiding grooves 50 which directionally orient conductive insert prongs 52 formed at the terminations of wires 54 secured to the insert plug 32. The parallelly aligned and diagonally upwardly oriented insert prongs 52 are, upon insertion, positioned within the prong guiding grooves 50 for engagement with conductive spades 56 which are mounted within the RJ11 plug 20. Insert locking tabs 58 are provided on the insert plug 32 and are engagable with corresponding locking surfaces (not illustrated) formed on the corresponding inside surfaces of the insert receiving receptacle 34. Likewise, the RJ11 plug 20 is formed with a locking tab 60 which engages a correspondingly formed tab receiving notch 62 formed in the complimentary receiving receptacle 22. The secondary RJ11 plug releasing port 48 permits insertion of a tool for releasing the RJ11 plug 20 from the RJ11 receptacle 22 in the event the locking tab 60 becomes inoperative.

Figure 5:
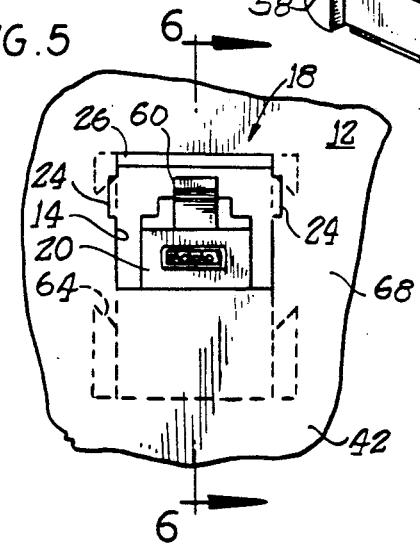
FIG. 5 is an enlarged front elevational view of one of the plugs as illustrated in FIG. 1 and also including ghost lines to illustrate the position of the rest of the plug coupler body behind the multiline panel.

FIG. 5 provides an enlarged front elevational view of one plug coupler 18 as shown in FIG. 1 mounted in a multiline panel 12. As described above, the plug coupler 18 is retained in the aperture 14 by the retention means 16 the top locking tab 26 and two side tabs 24, 24 of which engage an outside face 42 of the multiline panel 12. An RJ11 plug 20 is shown in engagement with the RJ11 receptacle 22 formed in the plug coupler 18 with the locking tab 60 in engagement with the locking tab notch 62. As will be described further hereinbelow, joining means such as keyway grooves 64 are formed on the sides of the coupler 18 as illustrated by the ghost lines in FIG. 5.

Figure 6:
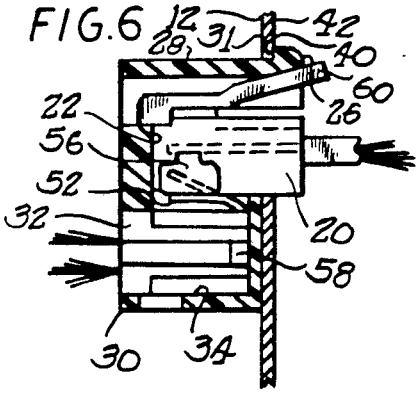
FIG. 6 is a partially sectionalized side view of the plug coupler as taken generally along the line 6—6 as illustrated in FIG. 5.

FIG. 6 provides a view of the plug coupler 18 as taken generally along the line 6—6 as illustrated in FIG. 5. As well as illustrating the engagement of the surface 40 of the top tab 26 with the outside face 42 of the multiline panel 12 and the restraining effect of the restraining face 44 abutting the inside surface 31 of the multiline panel 12, FIG. 6 provides a detailed illustration of the relative orientation of the plugs 20, 32 within the plug coupler 18. As shown in FIG. 6, the downwardly projecting conductive spades 56 of the RJ11 plug 20 are positively engaged by the resiliently mounted conductive prongs 52 of the insert plug 32.

As best viewed in FIG. 3, the conductive prongs 52 are directionally oriented by the prong guiding grooves 50 to engage the spades 56. The positive contact created between the spades 56 and the prongs 52 provide an electrical path between the two plugs 20, 32. Further, since the plug coupler 18 is integrally formed as a single piece body of a non-conductive or insulating material contact between the prongs 52 and the inside of the prong guiding grooves 50 will not result in crossing any of the connections to the corresponding spades 56. Additionally, since the plug coupler 18 is formed of non-conductive or insulating material such as a suitable plastic, the connection between the respective spades 56 and prongs 52 will be insulated from the multiline panel 12.

Turning to a further feature of the present invention, the plug coupler 18 as described hereinabove is provided with an environmental sealing member 66 which protects the coupler 18 against detrimental environmental effects. The environmental sealing member 66 is easily attached to the plug coupler 18 by inserting end portions 74 of a sealing key 70 into the correspondingly shaped joining keyway grooves 64 integrally formed on the sides of the plug coupler 18. In the embodiment of the plug coupler 18 as illustrated herein, the joining keyway grooves 64 are formed having generally trapezoidal cross-sections opening at the top or along the smaller of the two parallel sides 68 of the trapezoid.

Figure 7:
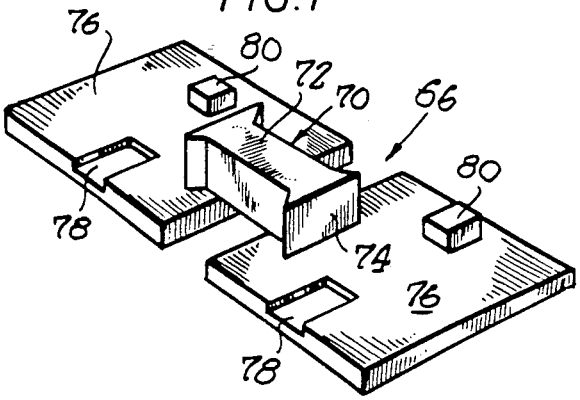
FIG. 7 is a perspective view of an environmental sealing member having two sealing platforms which are integrally formed with a sealing key therebetween.

As illustrated in FIG. 7, the environmental sealing member 66 is formed with the sealing key 70 which is comprised of a center joining bar 72, the ends 74 of which are generally trapezoidally shaped to engage a corresponding trapezoidal cross-sectional profile of the keyway grooves 64. The sealing key 70 is integrally formed with a sealing platform 76 integrally formed on or otherwise attached to each end of the center joining bar 72. The sealing platforms 76 cover a rearmost surface 78 of the rear portion 30 of the plug coupler 18. Each sealing platform 76 is formed with a recess 79 through which the wires 54 of the insert plug 32 feed when surface 76 abuts surface 78. A sealing plug 80 cooperatively mates with the secondary RJ11 plug releasing port 48 to provide positive indexing when attaching an environmental sealing member 66 to a plug coupler 18. To provide additional environmental sealing, a small amount of nonconductive silicone grease or gel can be applied about the recess 79 as well as to the surface of the sealing platform 76 which abuts the rearmost surface 78 of the plug coupler 18.

Figure 8:
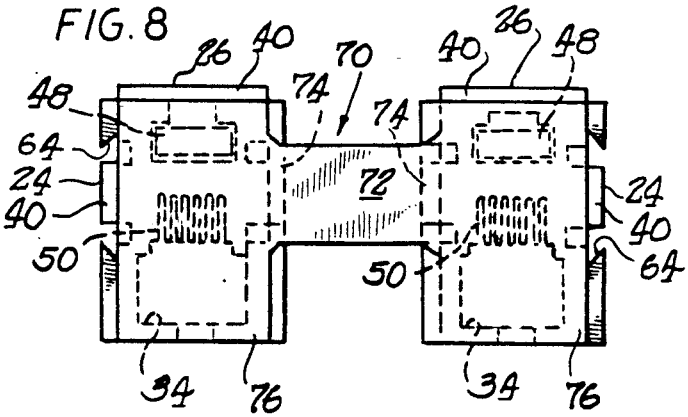
FIG. 8 is a back side elevational view of two plug couplers having the environmental sealing member of FIG. 7 positioned over the back side of the two plug couplers with the sealing key engaging respective trapezoidal grooves formed on the sides of each of the plug couplers.
Figure 9:
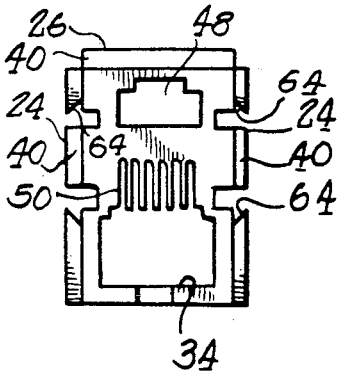
FIG. 9 is a rear elevational view of a plug coupler as shown in FIG. 8 with the environmental sealing member removed.

FIG. 8 provides a rear elevational view of two plug couplers having environmental sealing members 66 positioned over the rearsides of the two side couplers and having the sealing key 70 engaging the respective keyway grooves 64 formed on the sides of the plug couplers 18. The sealing platforms 76 cover the respective rearmost surfaces 78 of the respective plug couplers 18. The environmental sealing member 66 further provides for spacing between the plug couplers 18 when the plug couplers are mounted into a common aperture which the top tab 26, but not necessarily the side tabs 24, engage. By providing an environmental sealing member 66 with a degree of rigidity, a common aperture can be employed thereby eliminating the need to produce a plurality of individual apertures for each individual plug coupler 18.

In use, a multiline panel 12 is formed with individual plug apertures 14 through which the retention means 16 integrally formed on the front portion 28 of the plug coupler 18 is inserted. The retention means 16, comprising the flexible arm portions 38, 39 the ends of which are formed with snap lock tab portions 24, 26, are flexed to permit the projecting tab portions 24, 26 to pass through the aperture 14. Once the tab portions 24, 26 pass through the aperture 14 the flexible arm portions 38, 39 flex back to their relaxed "as-formed" state thereby causing surfaces 40, 41 on the tab portions 24, 26 to engage the outer face 42 of the multiline panel 12. Insertion of the plug coupler 18 into the aperture 14 of the multiline panel 12 is most easily accomplished by first urging the top tab 26 through the aperture 14 followed by application of a force sufficient to press the side tabs 24 past the corresponding sides of the aperture 14.

Once the plug coupler 18 is engaged with the multiline panel 12, the insert plug 32 is inserted into the insert receiving receptacle 34 with the insert prongs 52 attached to the insert plug 32 being inserted into the prong guiding grooves 50 formed in the insert receiving receptacle 34. Once inserted into the insert receiving receptacle 34, the insert plug 32 is securely retained therein by the insert locking tabs 58 formed on each side of the insert plug and corresponding notches formed on the inside of the insert receiving receptacle 34. On the opposite side of the plug coupler 18, the RJ11 plug 20 is inserted into the complimentary receiving receptacle 22. The position of the complimentary receiving receptacle 22 and the insert receiving receptacle 34 within the plug coupler 18 position the RJ11 plug 20 and the insert plug 32 relative each other to provide engagement of the insert prongs 52 with the corresponding spades 56 mounted within the RJ11 plug 20.

While particular embodiments of the present invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent after study. As such, the scope of the invention should not be limited by the particular embodiment and specific construction described herein, but should be defined in the appended claims and equivalents thereof. Accordingly, the aim of the appended claims is to cover all such changes and modifications as fall within the true spirit and scope of the invention.

The invention is claimed as follows:

1. A communication line plug coupler for use in a multiline equipment panel for receiving at least two communication line plugs, said coupler providing a primary demarcation point in determining system problems, said coupler comprising: a coupler body integrally formed as a single piece body having a front portion and a rear portion and side portions extending between said front and rear portions, said coupler body having at least one front receptacle formed in a surface of said front portion and at least one rear receptacle formed in a surface of said rear portion; flexible retention means formed on side portions of said coupler body for retaining said coupler in an aperture formed through said multiline equipment panel; said front receptacle and said rear receptacle being located in said coupler for maintaining electrical engagement between plugs inserted respectively therein; said coupler body being formed with keyway grooves along sides of said coupler body for receiving mating key means for joining a plurality of like coupler bodies together in a side-by-side fashion.

2. A plug coupler according to claim 1 wherein said coupler body is integrally formed of plastic.

3. A plug coupler according to claim 1 wherein said flexible retention means comprise at least one flexible arm portion having formed thereon at least one protruding tab portion, said arm portion and said tab portion being located and configured such that when said coupler is inserted through said aperture said flexible arm portion flexes slightly opposite the direction which said tab protrudes from said arm permitting said at least one front receptacle to enter the aperture and abut said multiline panel for receiving a plug therein and such that thereupon said arm returns to a relaxed position for engaging said tab against a surface of said panel to retain said coupler in engagement therewith.

4. A plug coupler according to claim 1 wherein said coupler body has a major axis extending generally parallel to axes extending through said front and rear receptacles, wherein said joining key grooves are formed integral with said coupler body in parallel axial alignment with said major axis and have generally trapezoidal cross sections opening towards the smaller base of said trapezoidal cross sections.

5. An assembly including at least one communication line plug coupler adapted to snap fit into a complimentary aperture, a panel having at least one aperture formed through the surface thereof for receiving said at least one coupler, said coupler comprising: a coupler body having a front portion and a rear portion; said front portion having at least one front receptacle formed therein and said rear portion having at least one rear receptacle formed therein; one of said front and rear portions abutting said aperture formed in said panel for receiving a matingly engagable plug inserted therethrough; said one of said front and rear portions abutting said aperture having flexible retention means integrally formed thereon for retaining said coupler in engagement through said aperture; said at least one front receptacle and said at least one rear receptacle being integrally formed in said coupler body and located for positioning removably engagable plugs inserted therein for electrical engagement therebetween, said coupler body being integrally formed as a single piece body; said coupler body being formed with keyway grooves along sides of said coupler body for receiving mating key members for joining a plurality of like coupler bodies together in a side-by-side fashion.

6. An assembly according to claim 5 wherein said coupler body is formed of a material having electrical insulating characteristics for electrically insulating said coupler from said panel.

7. An assembly according to claim 5 wherein said keyway grooves receiving said mating key members are formed on a sealing portion positioned over said coupler for sealing said coupler against detrimental environmental conditions.

8. An assembly according to claim 5 wherein a plurality of plug couplers are mounted in a common aperture and spaced relative to each other by said keyway grooves formed on said at least one side of each of said couplers and said mating key members engaged in neighboring keyway grooves.

* * * * *